United States Patent [19]

Reinehr et al.

[11] Patent Number: 4,508,672

[45] Date of Patent: Apr. 2, 1985

[54] CONTINUOUS DRY-SPINNING PROCESS FOR HIGHLY SHRINKABLE ACRYLONITRILE FILAMENTS AND FIBERS

[75] Inventors: Ulrich Reinehr; Toni Herbertz; Hermann-Josef Jungverdorben, all of Dormagen, Fed. Rep. of Germany

[73] Assignee: Bayer Aktiengesellschaft, Leverkusen, Fed. Rep. of Germany

[21] Appl. No.: 505,542

[22] Filed: Jun. 17, 1983

[30] Foreign Application Priority Data

Jul. 6, 1982 [DE] Fed. Rep. of Germany ..... 3225268

[51] Int. Cl.[3] ..... D01D 5/22; D01F 6/18

[52] U.S. Cl. ..... 264/78; 264/168; 264/206; 264/210.3; 264/210.8; 264/289.3; 264/290.5

[58] Field of Search ..... 264/206, 168, 78, 210.3, 264/210.8, 289.3, 290.5

[56] References Cited

U.S. PATENT DOCUMENTS

| | | | |
|---|---|---|---|
| 2,417,294 | 3/1947 | D'Alelio | 264/206 |
| 2,811,409 | 10/1957 | Clapp et al. | 264/206 |
| 2,851,435 | 9/1958 | Pivot | 264/206 |
| 3,739,054 | 6/1973 | Wieder et al. | 264/206 |
| 4,140,844 | 2/1979 | Lowasser | 264/206 |

FOREIGN PATENT DOCUMENTS

| | | | |
|---|---|---|---|
| 41-21578 | 12/1966 | Japan | 264/206 |

*Primary Examiner*—Donald Czaja
*Assistant Examiner*—Hubert C. Lorin
*Attorney, Agent, or Firm*—Sprung, Horn, Kramer & Woods

[57] ABSTRACT

Ready-for-dispatch highly shrinkable filaments and fibers made of acrylonitrile copolymers can be prepared in a continuous dry-spinning method in which:

(a) the spinning solution spun has a viscosity at 100° C. of 10 to 60 falling-ball seconds, (b) the evaporation of the solvent in the spinning cell is controlled in such a way that on leaving the spinning cell the solvent contact of the filaments is at most 10% by weight, relative to the solids content of the fiber, (c) before the stretch the filaments are treated with a spin-finish which contains a lubricant and an antistat and gives the filaments a moisture content of at most 10% by weight, relative to the solids content of the fiber, and (d) before or during the stretch the filaments have no contact with any other extraction liquid for the spinning solvent.

8 Claims, No Drawings

CONTINUOUS DRY-SPINNING PROCESS FOR HIGHLY SHRINKABLE ACRYLONITRILE FILAMENTS AND FIBERS

The invention relates to a continuous process for preparing crimped highly shrinkable filaments and fibres made of acrylonitrile coolymers which contain at least 40% by weight of acrylonitrile units. For the purposes of the invention, a continuous process is a process in which in one uninterrupted operation the filaments are dry-spun, stretched, crimped and, if desired, cut to give staple fibres.

Acrylic fibres are usually prepared by wet-, dry- or melt-spinning. While such continuous processes as are free of tow weight limits have already been disclosed for the wet- or melt-spinning of acrylic fibres, for example the wet-spinning process of Textiltechnik 26 (1976), pages 479–483, or the melt-extrusion process of German Offenlegungsschrift No. 2,627,457, only one continuous process for dry-spinning acrylic fibres has hitherto been disclosed, and this process can only be used for low tow weight multifilament yarns, so-called acrylic silk, and is subject to certain conditions, in particular high viscosity of the spinning solution (U.S. Pat. No. 2,811,409). This process cannot be used for preparing high-weight acrylic tows. Moreover, it cannot be used for preparing highly shrinkable filaments and fibres.

Highly shrinkable filaments and fibres are to be understood as meaning those filaments and fibres which have a boil shrinkage of greater than 35%. Such fibres are prepared at low degrees of stretch and low stretching temperatures (German Offenlegungsschriften Nos. 1,435,611 and 2,504,079).

The two processes which are used today on a large scale, namely the wet-spinning process and the dry-spinning process, have developed in time in different directions. In wet-spinning, where the spinning solution is spun into a coagulation bath and coagulated there to give filaments which are then without interruption washed, stretched, dried and spin-finished, spinning jets having a large number of holes, about 10,000, are used. At 5 to 20 m/min, the spin speed is relatively low. Because of the danger of the filaments sticking to one another in the several meters long spinning cell, dry-spinning can only be carried out with spinning jets having a relatively small number of holes, normally 200 to 1,000, but significantly higher take-off speeds are possible, usually between 200 and 1,000 m/min, so that dry-spinning achieves in principle production outputs similar to those in wet-spinning. However, because of the high spinning speeds the overall dry-spinning process could hitherto not be carried out in a continuous manner with high tow weights, since it was not possible, within this short period, to decrease the solvent content to below certain required values. For this reason the dry-spinning process is interrupted before the stretch and the spun material is collected in cans from which it is then fed into further processing (Bela von Falkai, Synthesefasern (Synthetic fibres), Verlag Chemie, Weinheim/Deerfield Beach, Florida/Basel (1981), pages 204–206; and R. Wiedermann, Acrylic fibre spinning and aftertreatment processes in Chemiefasern-/Textilindustrie, June 1981, pages 481–484, in particular at the top of the left-hand column on page 482).

Since it is economically and ecologically as well as for the uniformity of the spun material disadvantageous to run the spun material into cans, it is an object of the present invention to provide a continuous process for preparing highly shrinkable acrylic fibres by dry-spinning, in which all stages, from filament formation to the ready-for-despatch fibre, take place in one operation without any interruption or intermediate storage and which can be applied to high-weight tows. It should preferably be possible to incorporate the preparation of the spinning solution in the continuous process.

It has been found, surprisingly, that this object can be achieved if a spinning solution of a certain viscosity is used, the solvent content in the spun material is reduced in the spinning cell by a solvent removal method to below certain values, the filaments are treated before the stretch with a spin-finish which contains a lubricant and an antistat and preferably is an aqueous formulation, but the water absorption (moisture) of the filaments remains below certain values, and the filaments have no contact before or during the stretch with any other solvent-extracting liquid.

The invention therefore relates to a process for preparing highly shrinkable filaments and fibres made of acrylonitrile copolymers which contain at least 40% by weight of acrylonitrile units by spinning a spinning solution of the copolymer into a spinning cell, evaporating in the spinning cell at least some of the spinning solvent, spin-finishing, stretching at stretching temperatures of 65° to 100° C. and stretch ratios of at most 1:3.5, crimping and, if desired, cutting in a continuous operation, characterised in that (a) the spinning solution spun has a viscosity at 100° C. of 10 to 60 falling-ball seconds, (b) the evaporation of the solvent in the spinning cell is controlled in such a way that on leaving the spinning cell the solvent content of the filaments is at most 10% by weight, relative to the solids content of the fibre, (c) before the stretch the filaments are treated with a spin-finish which contains a lubricant and an antistat and gives the filaments a moisture content of at most 10% by weight, relative to the solids content of the fibre, and (d) before or during the stretch the filaments have no contact with any other extraction liquid for the spinning solvent.

The draw-down of the process is preferably greater than 2, in particular between 2 and 12. In a particularly preferred embodiment, the spinning solution has at 100° C. a viscosity of 15 to 50 falling-ball seconds, the solvent content of the filaments on leaving the spinning cell is at most 5% by weight, relative to the solids content of the fibre, and the stretch ratio is 1:2 to 1:3.5. Throughout the entire process the filaments preferably do not come into contact with any other extraction liquid for the spinning solution.

The draw-down V is defined as the ratio of the take-off speed A to the extrusion speed S:

$$V = \frac{A\ (m/min)}{S\ (m/min)}$$

The extrusion speed S is given by:

$$S = \frac{4 \times F_2}{Z \times d^2 \times \tau \times 100} \text{ where}$$

where:

F=delivery rate ($cm^3$/min)

Z=number of holes per spinning jet d=jet hole diameter (cm)

The delivery rate (pump volume times number of revolutions per minute) is given by the following equation:

$$G_{ST} = \frac{P \times U \times K \times 0.94 \times 10{,}000}{A \times 100} \text{ where}$$

where:

$G_{ST}$=total linear density (dtex=g/10,000 m)

P=pump volume ($cm^3$)

U=number of revolutions per minute ($min^{-1}$)

K=spinning solution concentration ($g/cm^3$)

A=take-off speed (m/min)

The process of the invention makes it possible to produce 100,000 or more dtex highly shrinkable tows which contain so little residual solvent that, after a hot stretch and a subsequent crimping process at at most 100° C., the residual solvent content in the finished fibre or tow is markedly below 5% by weight without the spun material having come into contact with an extracting agent for the spinning solvent apart from the water content of the spin-finish. The filaments obtained in the invention have fibre tenacities of 1.5 cN/dtex or more.

Suitable for use as acrylonitrile copolymers are all acrylonitrile polymers which can be spun into so-called acrylic fibres or modacrylic fibres, preferably acrylonitrile copolymers containing at least 85% by weight of acrylonitrile units. Terpolymers consisting of 89 to 95% by weight of acrylonitrile, 4 to 10% by weight of a non-ionic comonomer, for example methyl acrylate, methyl methacrylate or vinyl acetate and 0.5 to 3% by weight of an ionic comonomer, for example methallyl sulphonate or styrene sulphonate are particularly preferred. The polymers are known.

An essential feature of the process according to the invention is that as the spun material, that is to say, the tow, leaves the spinning cell it has a residual solvent content of less than 10% by weight, in particular between 2 and 5% by weight, relative to the dry weight of the fibre, since spun material containing more residual solvent, for example dimethylformamide, becomes tacky at tow temperatures around 100° C. during the subsequent stretch over godets or an undesirable cold elongation of the material takes place, that is to say a non-uniform and incomplete stretch under poorly defined conditions. Furthermore, it is necessary to wet the spun material before the stretch while still hot, preferably at the end of the spinning cell, either inside it or immediately thereafter, with a spin-finish which contains a lubricant and an antistat, and stretch it without allowing the hot spun material to cool down. The lubricant permits satisfactory stretching of even thick tows, of 100,000 dtex or more. The finish can also contain water as a component, but care should be taken to ensure that the tow does not absorb more than 10% by weight of moisture. If the tow has a higher water content, it cools down too much and unevenly, and shows during the subsequent stretch broken filaments or forms wraps round the godets.

Examples of suitable lubricants are glycols, their derivatives, silicone oils, ethoxylated fatty acids, alcohols, esters, amides and alkyl ether sulphates, and mixtures thereof. The finish can contain as antistat a suitable commercially available product, for example a conventional cationic, anionic or non-ionic compound such as a long-chain ethoxylated, sulphated and neutralised alcohol. The finish advantageously has a temperature of 50°-90° C. to prevent the hot sheet of filaments from cooling down. The individual tows spun in a machine which has, for example, 20 spinning cells and which have a total linear density of 100,000 dtex or more are treated with finish in this way and combined into one tow, which is passed over a take-off element to a pair of rolls which can be inductively heated. The tow is wound one or more times around the pair of rolls, if appropriate by means of a secondary roll, thereby establishing one clamping point. The second clamping point takes the form of a coolable take-off quintet or septet which is mounted about 3 m away from the inductively heated pair of rolls and which stretches the tow by virtue of its speed which has been set at an appropriately higher value. It is necessary to cool the rolls in the second stretching element to achieve, in the subsequent crimping process, the desired shrinkage level. The spinning solvent residues which escape in the course of the stretch are sucked away and recovered via a cooling system. The preferred stretching elements have been found to be septet rolls which can be heated at one end and can be cooled at the other end. It is advantageous to aid uniform performance of the stretching process, in particular in the case of high tow weights, by integrating between the septet rolls a tube which is heated with superheated steam or hot air.

Spinning take-off speeds of 50–100 m/min are generally sufficient to keep the residual solvent content in the spun material clearly below 10% by weight, so that, with a degree of stretch of up to 350%, technically manageable terminal speeds of at most 350 m/min are obtained.

Crimping is preferably carried out in a stuffer box. The crimped tow is then cut into staple fibres which are compressed into bales. The process is particularly suitable for preparing spun-dyed filaments and fibres through the addition of soluble dyestuffs, in particular cationic dyestuffs, or pigments to the spinning solution, since, due to the particular method of processing, a change in colour leads to significantly less reject material being produced.

Also, the preparation of the solution can be easily integrated into the continuous process, whether they be conventional ways of preparing the solution or, in particular, the following method:

First, a suspension is prepared at room temperature from the spinning solvent, the polymer and, if appropriate, such a non-solvent for the polymer as is miscible with the spinning solvent, for example water in an amount of 2 to 20 g per 100 g of polymer. This suspension is heated to a temperature which is at least 30 and at most 60° C. above those temperatures at which the suspension becomes optically homogeneous, that is turns into a solution, is held at this temperature for 1 to 15 minutes, and is then immediately passed to the spinning stage.

In a further embodiment of the invention, the spinning solution preparation stage is preceded by a solution polymerisation in the spinning solvent used, for example dimethylformamide, so that, after the solution has been suitably concentrated and has had its monomer removed via a thin-film evaporator, for the first time a highly automated continuous process has been achieved for dry-spinning highly shrinkable acrylic fibres.

A great advantage of the process is that a wash is no longer necessary, which also dispenses with the previously necessary drying process.

The fibres obtained according to the invention have a density of greater than 1.165 g/cm$^3$ and are void-stable. Since, moreover, the high shrinkage tow can be crimped in the dry state, a remarkably high adhesion and such a high carding speed, generally greater than 100 m/min, as to be unknown for acrylic high shrinkage fibres are obtained in yarn spinning. A further advantage of the dry heat stretch is also the very good staple fibre distribution, with very few short or long fibres. Conventional processes for preparing high shrinkage fibres give none of these advantages, because washes are inserted to remove spinning solvent.

The viscosity in falling-ball seconds, measured at 100° C., was determined in accordance with the method of K. Jost, Reologica Acta, volume 1 (1958), page 303. The following conversion rule applies: 1 falling-ball second equals 4.37 poise.

All temperatures measured in the course of the continuous acrylic fibre production process from the spinning machine onwards were measured in a contact-free manner with a KT 15 radiation thermometer (manufacturer: Heimann GmbH, Wiesbaden, West Germany).

EXAMPLE 1

700 kg of dimethylformamide (DMF) are mixed in a vessel at room temperature with stirring with 300 kg of an acrylonitrile copolymer which consists of 93.6% of acrylonitrile, 5.7% of methyl acrylate and 0.7% of sodium methallyl sulphonate and which has a K value of 81. The suspension is pumped by a gear pump into a spinning vessel which is equipped with a stirrer. The suspension is then heated in a jacketed pipe with steam at 4.0 bar. The dwell time in the pipe is 5 minutes. The spinning solution, which at the pipe outlet has a temperature of 138° C. and a viscosity of 19 falling-ball seconds, measured at 100° C., is cooled down to 90° C. on leaving the heating-up apparatus, filtered and directly passed into a spinning unit which has 20 spinning cells.

The spinning solution is dry-spun through a spinning jet which has 1,264 0.2 mm diameter holes, with a take-off speed of 50 m/min and a draw-down of 2.4. The dwell time of the filaments in the spinning cells is 5 seconds. The spinning cell temperature is 200° C., and the air temperature is 360° C. Air is blown into each cell with a rate of 40 m$^3$/h.

The spun material, which has a total linear density of 343,000 dtex and a residual solvent content of 2.8% by weight, relative to the solids content, is wetted, immediately after leaving the spinning cells and before entry into the downstream tube, with a warm, aqueous, oil-containing, antistatic finish at 80°–90° C. in such a way that the oil content of the filaments is 0.16% by weight, the antistat content is 0.04% by weight and the moisture content is 1.1% by weight, relative to the solids content of the fibre. The spin-finish is metered out via gear pumps.

The tube downstream of the spinning cells is supplied with hot air at 300° C. in countercurrent to the moving filaments to remove DMF. The warm tow is then passed over an inductively heated septet of rolls at 145° C. In the course of this passage, the tow assumes a temperature of 85° C., measured with a KT 15 radiation thermometer. The tow is then stretched by 250%, the second clamping point comprising a stretching septet having coolable rolls. After the stretch the tow has a temperature of 39° C. Immediately thereafter the tow is crimped in a stuffer box and treated with cold air at room temperature in a U-shaped tube to retain the shrinkage level. The highly shrinkable acrylic tow is then cut into 80 mm long staple fibres, which are passed into a packing press.

The highly shrinkable acrylic fibres thus prepared in a continuous process have a final individual fibre linear density of 5.0 dtex. The fibre shrinkage determined in boiling water is 44.4%, the density before the boil is 1.174 g/cm$^3$ and after the boil 1.171 g/cm$^3$. The fibre tenacity is 1.8 cN/dtex and the elongation at break 70%. The fibres are void-stable and have a completely smooth texture-free surface. The fibres can be processed on a high-performance carding machine at 120 m/min. The short and long fibre contents in the staple diagram are less than 2%.

Table 1, below, shows the shrinkage behaviour of spun material which has the same total linear density of 343,000 dtex for various tow temperatures and degrees of stretch. The high shrinkage fibres were otherwise prepared as in Example 1.

As can be seen from the Table, high fibre shrinkage of greater than 35% is only obtained at degrees of stretch of up to 350% and tow temperatures of up to 100° C. At very low tow temperatures, for example at 60° C., the spun material is only cold-stretched. There are frequent jams and breaks in the stretching zone. All cases again give a density of greater than 1.165 g/cm$^3$ before and after the boil.

TABLE 1

| No. | Tow temperature °C. | Degree of stretch | % age fiber shrinkage at the boil | Linear density in dtex | Tenacity in cN/dtex | Elongation at break | Comment |
|---|---|---|---|---|---|---|---|
| 1 | 60 | 1:2.5 | — | — | — | — | breaks |
| 2 | 70 | 1:2.5 | 40.3 | 5.1 | 1.5 | 95 | |
| 3 | 80 | 1:2.5 | 47.4 | 5.0 | 1.7 | 82 | |
| 4 | 90 | 1:2.5 | 40.7 | 4.9 | 1.8 | 71 | |
| 5 | 100 | 1:2.5 | 36.6 | 5.0 | 1.8 | 68 | |
| 6 | 110 | 1:2.5 | 31.1 | 5.0 | 1.8 | 67 | |
| 7 | 80 | 1:3.0 | 42.9 | 4.5 | 2.1 | 60 | |
| 8 | 90 | 1:3.0 | 38.3 | 4.4 | 2.2 | 54 | |
| 9 | 100 | 1:3.0 | 35.9 | 4.4 | 2.2 | 51 | |
| 10 | 90 | 1:3.5 | 35.7 | 3.8 | 2.3 | 50 | |
| 11 | 100 | 1:3.5 | 35.1 | 3.8 | 2.4 | 48 | |
| 12 | 110 | 1:3.5 | 29.2 | 3.7 | 2.4 | 44 | |
| 13 | 100 | 1:3.6 | 30.1 | 3.6 | 2.5 | 41 | |

EXAMPLE 2

1.18% by weight, relative to solids content, of the red dyestuff of the formula

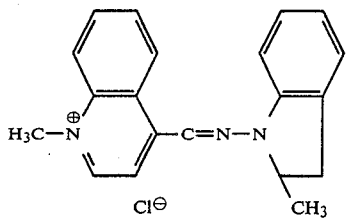

and 0.11% by weight, relative to solids content, of the yellow dyestuff of the formula

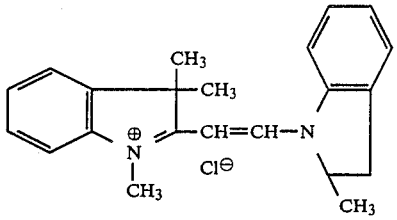

are added in a spinning vessel to a suspension as in Example 1, to obtain a carmine colour, and the mixture is then heated in the manner described in Example 1, converted into a spinning solution and spun into carmine high shrinkage fibres, which are aftertreated. The high shrinkage fibres have a linear density of 5.1 dtex. The fibre shrinkage at the boil is 44.8%. The density of the carmine high shrinkage fibres before the boil is 1.172 g/cm$^3$ and after the boil 1.166 g/cm$^3$. The fibre tenacity is 1.7 cN/dtex and the elongation at break is 66%. The fibres can be processed on a high-performance carding machine at 110 m/min.

EXAMPLE 3

0.04% by weight of carbon black, relative to the solids content, 0.02% by weight of pigment red and 0.09% by weight of pigment yellow are added to a suspension as in Example 1 to give a beige colour, and the mixture is heated in the manner described in Example 1, converted into a spinning solution and aftertreated. However, the fibres were stretched at a ratio of 1:3.5 at a tow temperature of 100° C. The beige high shrinkage fibres have a final linear density of 3.8 dtex and a boil shrinkage of 35.3%. The fibre tenacity is 2.3 cN/dtex and the elongation at break is 50%. The density is 1.172 g/cm$^3$ before the boil and 1.165 g/cm$^3$ after the boil. The fibres can be processed on a high-performance carding machine at 100 m/min.

We claim:

1. A process for preparing a highly shrinkable filament or fiber made of an acrylonitrile copolymer containing at least 40% by weight of acrylonitrile units which consists essentially of:

(A) continuously dry-spinning a spinning solution of an acrylonitrile copolymer containing at least 40% by weight of acrylonitrile units which spinning solution has a viscosity at 100° C. of 10 to 60 falling-ball seconds;

(B) continuously evaporating solvent in the spinning cell through which said spinning solution passes in such a way that on leaving the spinning cell the solvent content of the resultant filaments is at most 10% by weight, relative to the solids content of the fiber or filament;

(C) continuously applying to fiber or filament as spun a lubricant and an anti-static composition while maintaining the moisture content of the filaments or fibers at at most 10% by weight, relative to the solids content of the fiber or filament;

(D) continuously stretching the resultant fibers or filaments at a stretching temperature of 65 to 100° C. at a stretching ratio of at most 1:3.5 while insuring that before or during the stretching the filaments have no contact with any other extraction liquid for the spinning solvent; and (E) continuously crimping the resultant so stretched filaments.

2. Process according to claim 1, characterised in that the draw-down of the process is greater than 2.

3. Process according to claim 1, characterised in that the spinning solution has a viscosity of 15–50 falling-ball seconds at 100° C., the solvent content of the filaments on leaving the spinning cell is at most 5% by weight, relative to the solids content of the fibre and the stretch ratio is 1:2 to 1:3.5.

4. Process according to claim 1, characterised in that the preparation of the spinning solution is incorporated in the continuous process.

5. Process according to claim 1, characterised in that the spinning solution is prepared by solution polymerisation in the spinning solvent used.

6. Process according to claim 1, characterised in that soluble dyestuffs or pigments are added to the spinning solution and spun-dyed filaments and fibres are produced.

7. Process according to claim 1, characterised in that the stretch is carried out with tows of at least 100,000 dtex.

8. A process according to claim 1 wherein the fibers or filaments are stretched subsequent to application of the lubricant and anti-static composition without cooling down prior to the stretching.

* * * * *

UNITED STATES PATENT AND TRADEMARK OFFICE

CERTIFICATE OF CORRECTION

PATENT NO. : 4,508,672

DATED : April 2, 1985

INVENTOR(S) : Ulrich Reinehr, et al

It is certified that error appears in the above-identified patent and that said Letters Patent is hereby corrected as shown below:

The term of this patent subsequent to March 19, 2002, has been disclaimed.

Signed and Sealed this

*Seventeenth* Day of *September 1985*

[SEAL]

*Attest:*

*Attesting Officer*

DONALD J. QUIGG

*Commissioner of Patents and Trademarks—Designate*